US006494737B1

(12) United States Patent
Daoud et al.

(10) Patent No.: US 6,494,737 B1
(45) Date of Patent: Dec. 17, 2002

(54) WIRE CONNECTOR BLOCK FOR USE WITH PRINTED WIRE BOARDS AND WIRE WRAPPING

(75) Inventors: Bassel H. Daoud, Parsippany, NJ (US); George A. Debalko, Long Valley, NJ (US); Antonio A. Figueiredo, Long Valley, NJ (US); Adam S. Kane, Morristown, NJ (US); Christopher M. Helmstetter, Bridgewater, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/401,558

(22) Filed: Sep. 22, 1999

(51) Int. Cl.[7] ..... H01R 4/24; H01R 4/26; H01R 11/20

(52) U.S. Cl. ..... 439/404; 439/408; 439/83

(58) Field of Search ..... 439/405, 77, 404, 439/406, 408, 83, 84, 409, 403

(56) References Cited

U.S. PATENT DOCUMENTS 4,311,356 A * 1/1982 Levitt ..... 339/99 R
4,385,791 A * 5/1983 Lovrenich ..... 339/17 C
4,416,497 A * 11/1983 Brandsness et al. ..... 339/17 F
4,438,999 A * 3/1984 Lang ..... 339/176 MF
4,494,813 A * 1/1985 Daley, Jr. et al. ..... 339/99 R
4,770,645 A * 9/1988 Antes ..... 439/329
5,139,440 A * 8/1992 Volk et al. ..... 439/413
5,513,075 A * 4/1996 Capper et al. ..... 361/773
RE35,476 E * 3/1997 Levy ..... 439/411
5,681,182 A * 10/1997 Reichle ..... 439/417
5,871,378 A * 2/1999 Poiraud et al. ..... 439/676
6,074,239 A * 6/2000 Camps ..... 439/409

* cited by examiner

*Primary Examiner*—Karl D. Easthom
*Assistant Examiner*—Kyung Lee
(74) *Attorney, Agent, or Firm*—Stroock & Stroock & Lavan LLP

(57) ABSTRACT

A wire connector block is provided which is formed to be used with both wire wrapping and wave soldering in connecting wires to wire connectors mounted thereon. Additionally, a method is disclosed for mounting a ribbon wire onto a printed wire board (PWB) that is connected to wire connectors. The ribbon wire is manipulated, preferably bent, to define an enclosed space with the printed wire board in which is disposed a material that is resistant to the passage of moisture therethrough.

20 Claims, 5 Drawing Sheets

WIRE CONNECTOR BLOCK FOR USE WITH PRINTED WIRE BOARDS AND WIRE WRAPPING

FIELD OF THE INVENTION

This invention relates to the field of surface mountable wire connector blocks formed for holding a plurality of wire connectors, and, more particularly, to methods for establishing connections with the wire connectors.

BACKGROUND OF INVENTION

Wire connector blocks are known in the prior art which are formed to be mounted to an opening in a mounting surface, such as a panel, to fixedly support a plurality of wire connectors relative to the mounting surface. The wire connectors are used to define electrical connections between wires located on both sides of the panel. Typically, the wire connectors are insulation displacement connectors (IDC's). IDC's are formed to grippingly engage wire conductors inserted thereinto, thereby forming electrical connections between the electrical conductors and the IDC's. Where used with a panel-mounted wire connector block, the IDC's are disposed to grippingly engage wire conductors located in front of the panel, and have terminal strips which protrude from the rear of the panel. In turn, wires are connected to the terminal strips typically in one of two ways.

First, individual wires may be wrapped about the terminal strips in a procedure aptly named "wire wrapping". The wires are wrapped helically about the terminal strips to define contiguous loops, with often ten loops being formed to ensure an acceptable electrical connection is defined. To ensure continued integrity of the connections, liquid potting material is poured about the terminal strips and the wrapped wires, and solidified. The potting material-application process is facilitated by a wall extending rearwardly of the wire connector block, which encircles all of the protruding terminal strips, and acts as a mold for the potting material. As is readily appreciated, the terminal strips must be formed with sufficient length to accommodate all of the wound loops. Commonly, the terminal strips are formed with a length of 0.375" to provide sufficient length about which a wire can be wrapped. Also, the rearwardly-extending wall is typically formed to extend coextensively with, and even beyond, the terminal strips to ensure sufficient volume is defined to encompass the terminal strips and wrapped wires with the potting material. With this embodiment, the resulting structure is a plurality of discrete wires extending from the solidified potting material.

Second, a printed wire board (PWB) may be mounted onto the terminal strips and fastened thereto using wave soldering. Wires are then connected to the PWB and extended therefrom to other locations. Since no wires need be wrapped about the terminal strips, the terminal strips are formed shorter than where wire wrapping is used, and typically with a length 0.125". Additionally, the wire connector block is not formed with a rearwardly-extending wall, since no potting material is used.

Due to the use of two different methods for mounting wire to wire connectors, wire connectors have been formed with terminal strips of two different lengths. Additionally, two different wire connector block designs have been developed in the prior art: those having and those not having a wall that extends rearwardly sufficiently to define an appropriate mold for potting material. However, it is undesired to maintain two inventories of wire connectors and, separately, two inventories of wire connector blocks.

SUMMARY OF THE INVENTION

To overcome shortcomings in the prior art, a wire connector block is provided which is formed to mount onto a mounting surface (e.g. a panel), and which is formed with a rearwardly extending wall. A tab extends from the wall which provides a surface for engaging a PWB. Wire. connectors are used with the wire connector block having lengths greater than the wall, so as to extend therebeyond. It is preferred that IDC's be used having terminal strips which extend beyond the rearwardly-extending wall. In this manner, wire wrapping can be used to connect wires about portions of the terminal strips recessed below the wall, and, alternatively, portions of the terminal strips extending beyond the wall can be wave soldered to a PWB. The wall acts as a mold for potting material where wire wrapping is used. Other wire connectors known to those skilled in the art that are usable with mounted wire connector blocks may be used with the subject invention.

Additionally, a method is provided for mounting wires to a PWB secured to the wire connectors. In particular, a ribbon wire is connected to the PWB using any technique known by those skilled in the art, including soldering, and the use of a releasable connector. The ribbon wire is bent to extend at least partly across and in proximity to the PWB so as to define an enclosed space therebetween. A substance, such as silicon gel, may be injected into the enclosed space to shield the terminal strips and the PWB from external environmental effects.

It is preferred than the ribbon wire be connected to the top surface of the PWB (i.e., the surface of the PWB facing the wire connector block). As such, the ribbon wire must be bent around the edge of the PWB to be able to extend across and in proximity to the PWB, and, the bending of the ribbon wire provides strain relief thereto.

As an additional feature, a wire guide preferably extends from the wire connector that includes a slot extending therethrough shaped to accommodate the passage of the wire ribbon. The wire guide is located adjacent to the mounted PWB, and preferably opposite to the point(s) of connection of the ribbon wire with the PWB, so as to receive the wire ribbon after extending across the PWB. The wire guide provides stability to the assembly and limits movement of the wire ribbon relative to the PWB. Additionally, it is preferred that a channel be formed in the wire guide extending from the peripheral edge into communication with the slot. Advantageously, the ribbon wire can be passed laterally through the channel and into the slot, thereby avoiding the necessity of threading the entire ribbon wire through the slot.

The method of the subject invention forms an assembly of wire connectors, a PWB, a wire ribbon, and, silicon gel, that results in a stable collection of wire connections and wires that are easy to manage.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
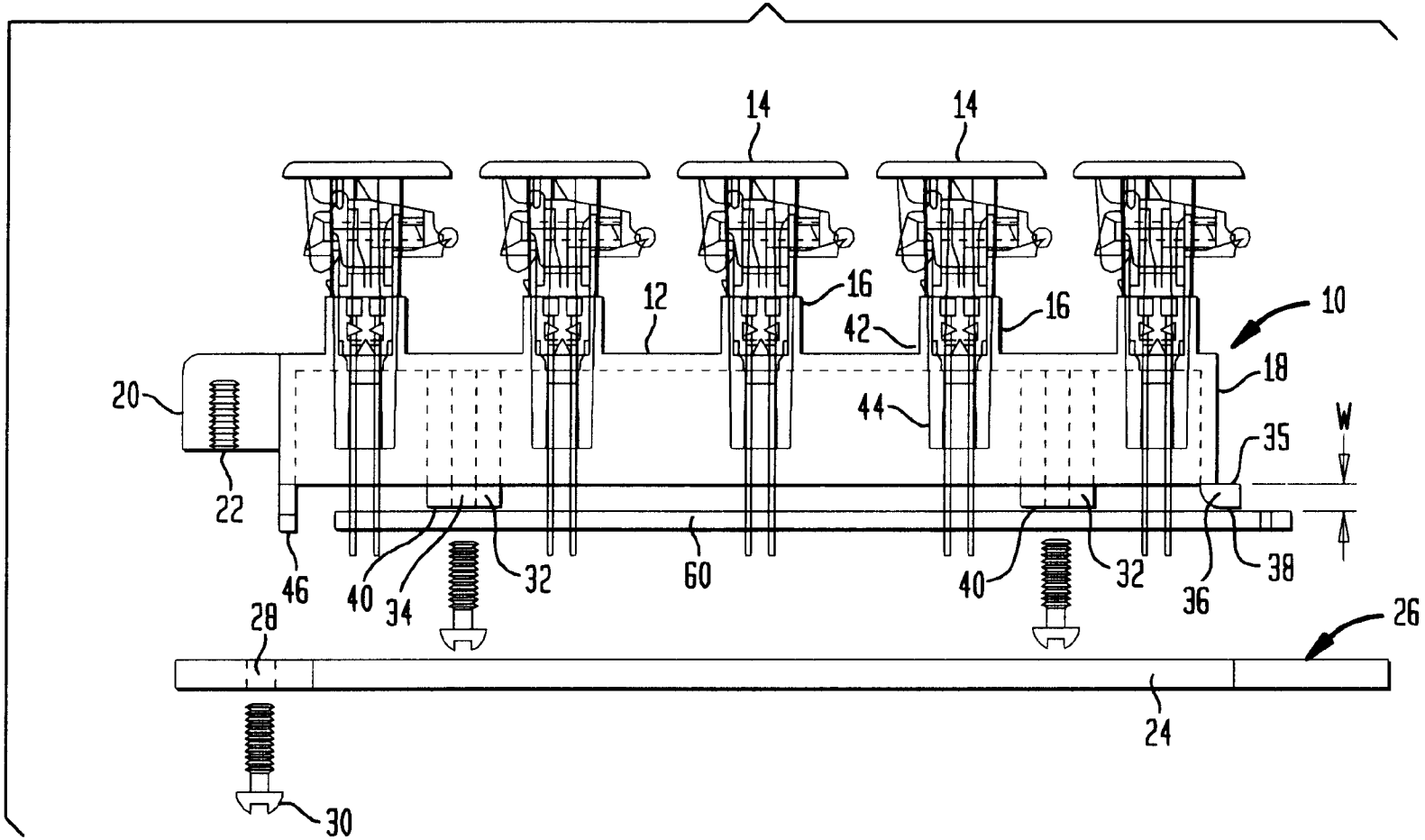
FIG. 1 is an exploded schematic view of a portion of the assembly of the subject invention.

With reference to FIG. 1, a wire connector block 10 is shown having a base 12 to which are mounted a plurality of wire connectors 14. The wire connectors 14 are shown as insulation displacement connectors (IDC's) in the figures. It is preferred that IDC's be used with the subject invention but other types of wire connectors known to those skilled in the art that are typically used with mounted wire connector blocks may be used. By way of non-limiting example, IDC's will be shown and described.

The base 12 is formed with a plurality of sockets 16 that are formed to receive and hold the wire connectors 14. The design(s) of the sockets 16 are known in the prior art. An upstanding wall 18 extends downwardly from the base 12 and preferably bounds the base 12. At least one boss 20 extends from the side of the wall 18 in which is formed aperture 22. The aperture 22 is preferably threaded.

The wire connector block 10 is formed to mount into an opening 24 formed in a mounting surface 26, such as a panel. As with prior art wire connector block designs, the wall 18 is formed to pass into and register with the opening 24 in the mounting surface 26. To provide holding force for securely maintaining the wire connector block 10 mounted to the mounting surface 26, a screw hole 28 is formed through the mounting surface 26, and a screw 30 is passed therethrough into threaded engagement with the aperture 22.

Additionally, the wire connector block 10 is formed with support posts 32 that extend from the base 12. The support posts 32 are each formed with a threaded hole 34, and, preferably, extend beyond the wall 18. A tab 36 depends from the wall 18, at a location opposite to the boss 20. The tab 36 extends outwardly from the wall 18 to define engaging surface 35. Additionally, the tab 36 defines an outer support surface 38 that is preferably coplanar with end surfaces 40 of the support posts 32. With this arrangement, a locus of points is defined by the support surface 38 and the end surfaces 40 for providing support for a printed wire board, as described below. The tab 36 defines a thickness w between the surfaces 35 and 38. The thickness w is determined by the amount of spacing that is desired between the mounting surface 26 and a mounted PWB.

Figure 4:
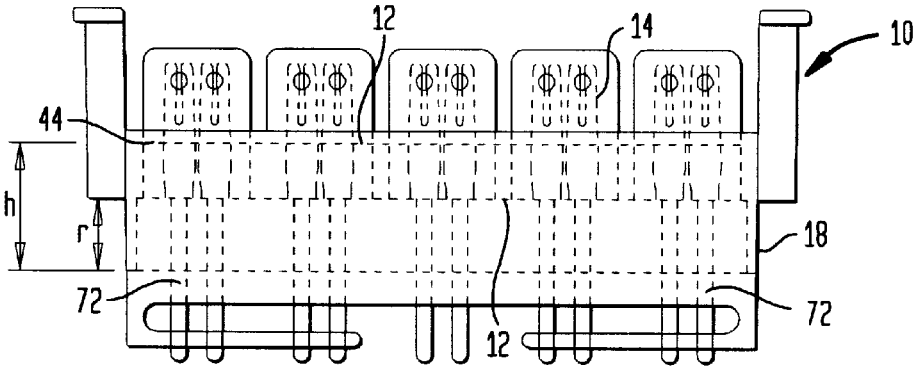
FIG. 4 is an end view of the wire connector block having wire connectors (IDC's) mounted therein.

The sockets 16 have upper portions 42 that extend upwardly from the base 12, and lower portions 44 that extend downwardly from the base 12. The lower portions 44 are encircled by the wall 18, and preferably are recessed below the wall 18 (i.e., formed with a shorter length as measured from the base 12, than the wall 18). Referring to FIG. 4, the lower portions 44 are recessed below the wall 18 a distance r. The distance r is selected such that the wire connectors 14 can be wire wrapped about portions located between the lower portions 44 and the end of the wall 18, and a matrix of potting material applied thereabouts.

Figure 2:
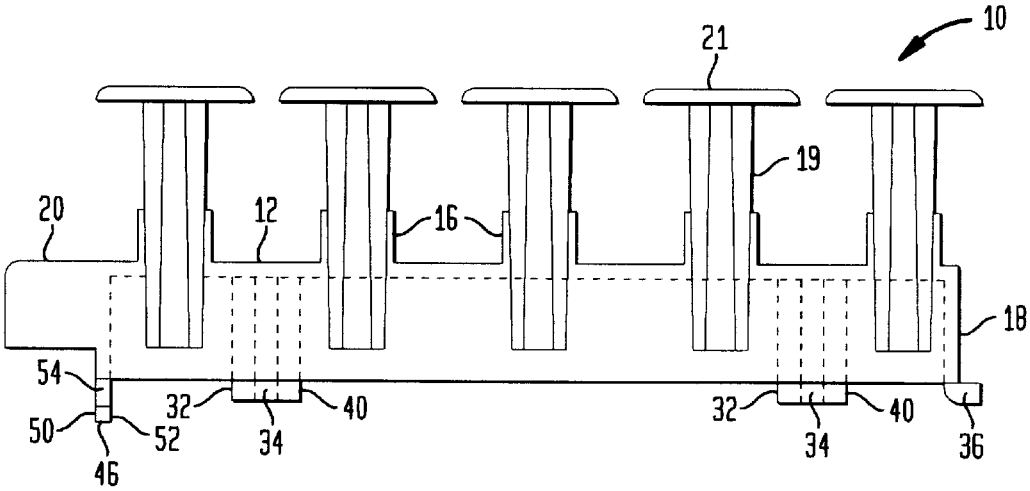
FIG. 2 is a side elevational view of a wire connector block.

As shown in FIG. 2, identifying members 19 may be provided along longitudinal sides of the wall 18. As known in the prior art, the identifying members 19 may bear numbers, or other indicia, on top surfaces 21. It must be noted that FIG. 1 is a schematic representation of a cross-sectional view of the wire connector block at a location spaced from its longitudinal edges, whereas, FIG. 2 is an elevational view of the side of the wire connector block. In other words, the sockets 16 are disposed between the identifying members 19.

Figure 3:
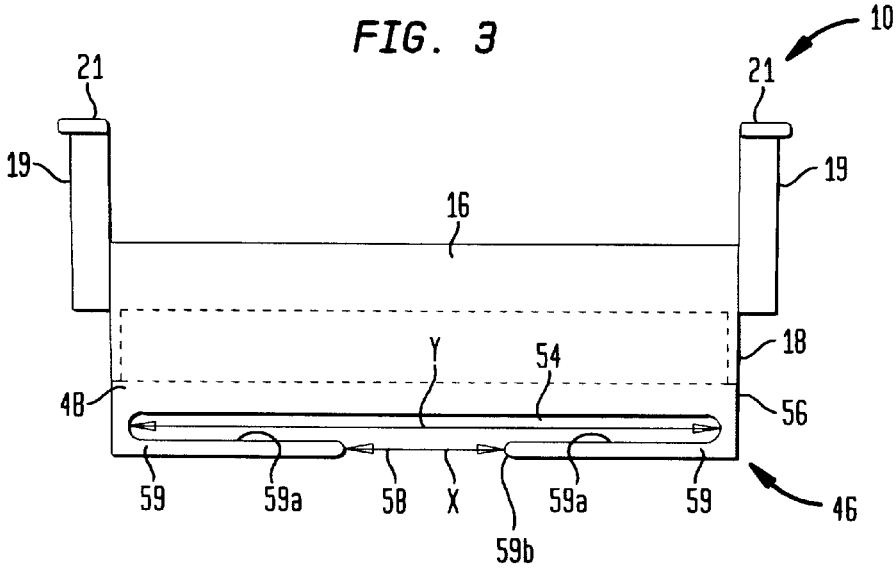
FIG. 3 is an end elevational view of the wire connector block shown in FIG. 2.

Referring to FIGS. 2 and 3, the wire connector block 10 is also formed with a wire guide 46. The wire guide 46 includes a guide body 48 that has first and second surfaces 50, 52, respectively, and a slot 54 extending between and through the surfaces 50, 52. It is preferred that the slot 54 be formed to be generally parallel to the base 12. Furthermore, the guide body 48 defines a peripheral edge 56 into which extends a channel 58 that is in communication with the slot 54. The guide body 48 defines elongated members 59 which have inner surfaces **59*a*, which define portions of the slot 54, and ends 59*b*, which define the channel 58. The channel 58 defines a width X which is less than a width Y defined by the slot 54. Both the slot 54 and the channel 58 are spaced from the base 12**.

Referring to FIG. 4, the wire connectors 14 are formed to extend beyond the wall 18. Specifically, the wall 18 is formed with a length h as measured from the base 12. Terminal strips 72 of the wire connectors 14 have lengths greater than the length h, and thus extend beyond the wall 18. As such, portions of the terminal strips 72 recessed below the wall 18 can be wire wrapped, and the wall 18 can be used as a mold for potting material. Alternatively, portions of the terminal strips 72 extending beyond the wall 18 can be wave soldered to a PWB, as described below. With the subject invention, one design of wire connector, having the same terminal strip length, and one design of wire connector block can be used to handle all typical applications.

Figure 5:
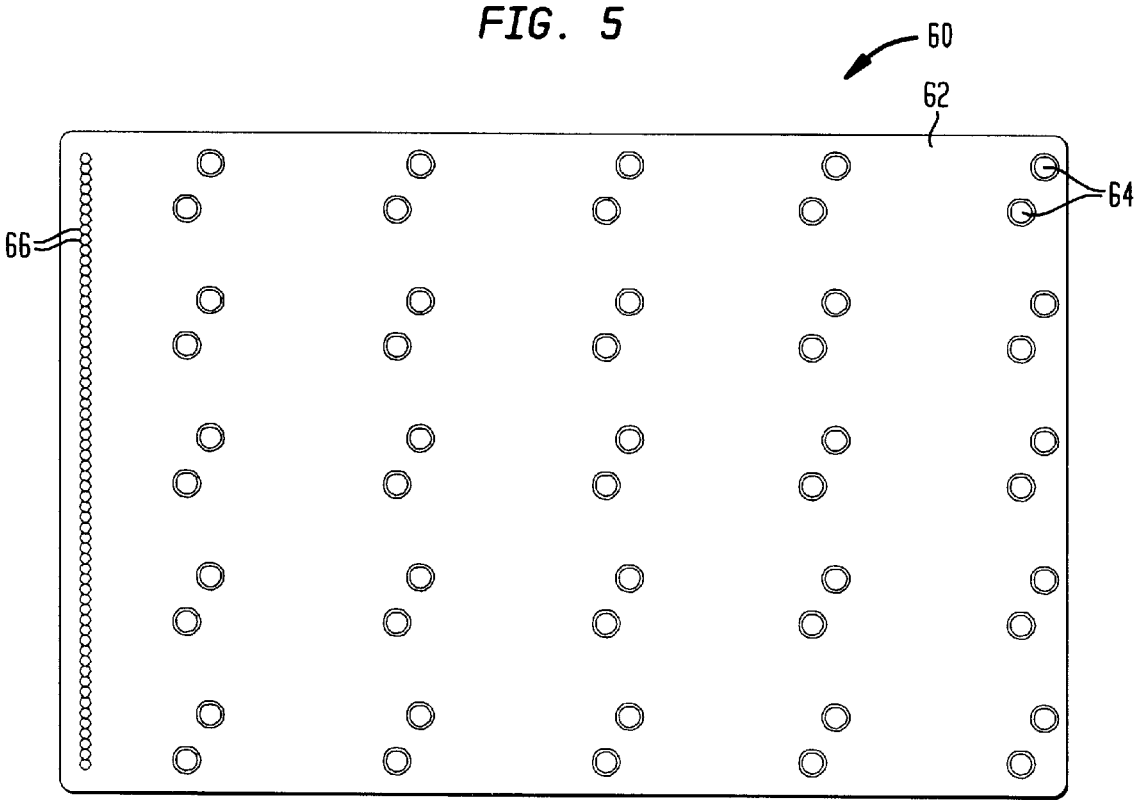
FIG. 5 is a top plan view of a printed wire board (PWB)
Figure 7:
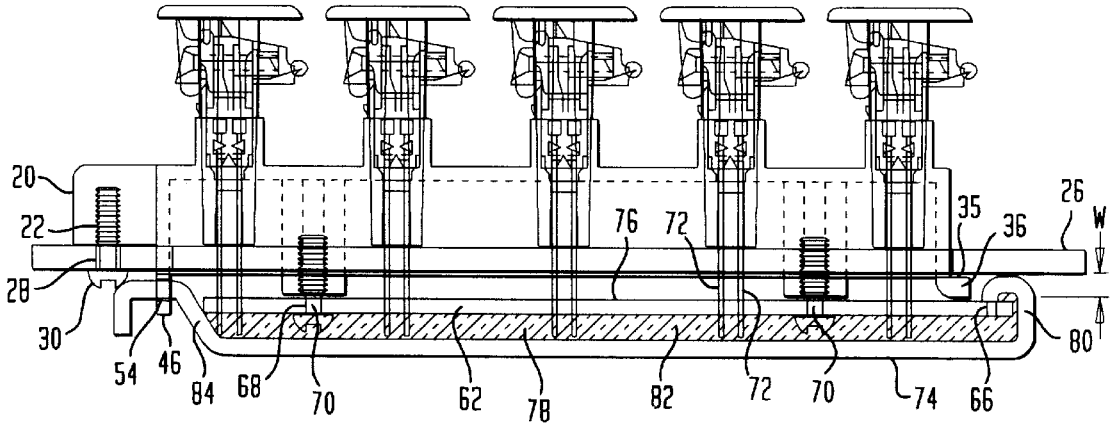
FIG. 7 is a side schematic view of the assembly of the subject invention; and, FIG. 8 is an end elevational view of the assembly shown in FIG. 7.

In addition to the wire connector block 10, the assembly of the subject invention includes a printed wire board (PWB) 60. Any design of PWB known in the prior art may be used. By way of non-limiting example, the PWB 60 shown in FIG. 5 includes a generally flat substrate 62, a plurality of contact engaging wells 64, and a plurality of output connections 66. The output connections 66 are electrically connected to the wells 64 through a maze of conductive vias formed within the substrate 62. To facilitate mounting of the PWB 60, it is preferred that mounting apertures 68 be formed in the substrate 62, as shown in FIG. 7.

Figure 6:
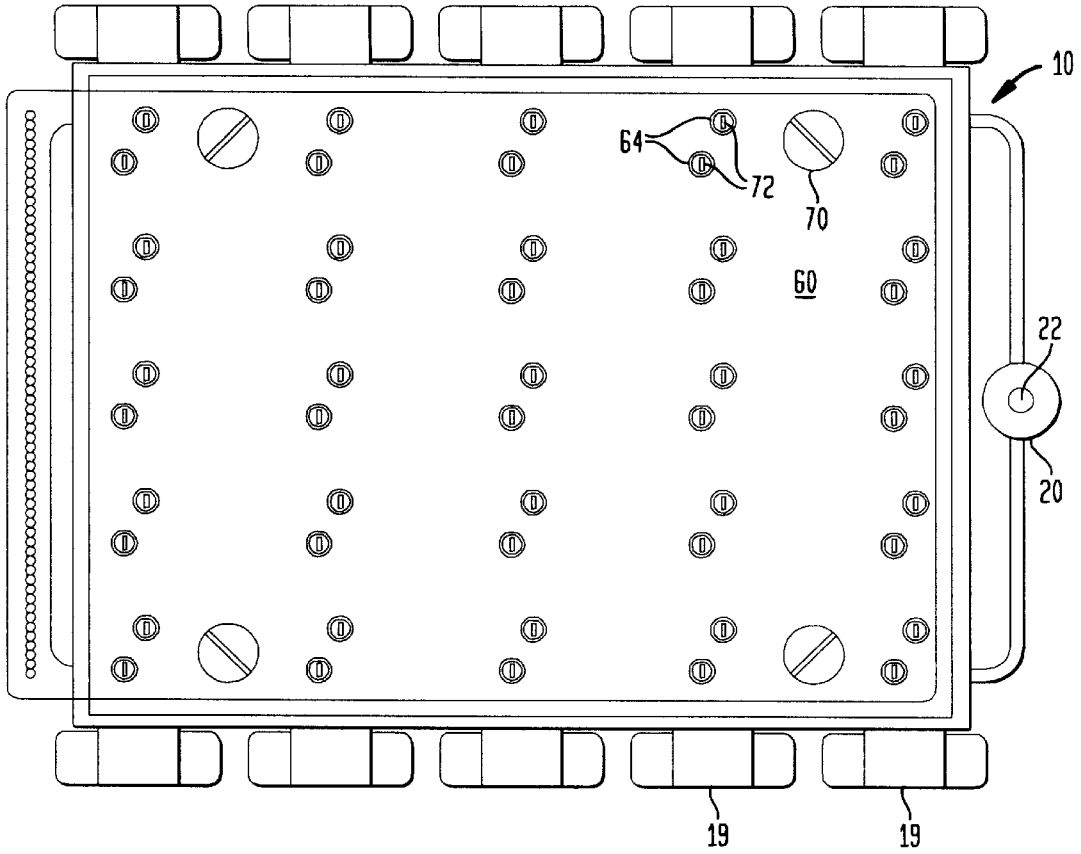
FIG. 6 is a bottom plan view of the PWB mounted to the wire connector block.

FIG. 6 depicts the PWB 60 mounted to the wire connector block 10 using screws 70.

With the PWB 60 being mounted as shown, portions of the wire connectors 14 are in contact with the wells 64 to form electrical connections therewith. As shown in FIG. 7, the terminal strips 72 pass through and contact the wells 64. Also, as shown in FIG. 7, it is preferred that the PWB 60 be in simultaneous engagement with the end surfaces 40 of the support posts 32 and the outer support surface 38 of the tab 36.

With the PWB 60 being mounted to the wire connector block 10, the assembly can be mounted into the opening 24 in the mounting surface 26 by passing the tab 36 through the opening 24 and causing the engaging surface 35 to impinge upon the mounting surface 26. The screw 30 is then passed through the screw hole 28 and into threaded engagement with the aperture 22.

Thereafter, a ribbon wire 74 may be connected to the PWB 60 to provide connections to external locations. In accordance with the subject invention, it is preferred that the ribbon wire 74 be connected to the output connections 66 at a top surface 76 (surface facing the wire connector block 10 and the wire connectors 14) of the substrate 62. As. shown in FIG. 7, the conductors of the ribbon wire 74 extend into and through the output connections 66 of the PWB 60. As used herein, the reference to connecting the ribbon wire 74 to the top surface 76 means that the ribbon wire 74 extends away from the top surface 76. Wave soldering can be used to strengthen the connections made at the PWB 60. Other forms of establishing connections known in the prior art may be used. For example, a releasable connector can be used to connect the ribbon wire 74 to the PWB 60. Regardless of the method used, it is preferred that the ribbon wire 74 be connected to the top surface 76.

Once connected, the ribbon wire 74 is manipulated to extend at least partly, preferably entirely, across and in proximity to the PWB 60 to define an enclosed space 78 therewithin. It is preferred that the ribbon wire 74 extend across the entire PWB and be manipulated so as to define a sharp bend 80 about a portion of the PWB 60. The sharp bend 80 provides strain relief to the ribbon wire 74.

Material 82 that is resistant to the passage of moisture therethrough, preferably silicon gel, is injected into the enclosed space 78. The material 82 provides a protective barrier against environmental effects, particularly ingress of moisture, for the electrical connections formed at the PWB 60. This is especially beneficial where the entire assembly is located outside with minimal housing. Additionally, the material 82 should have insulative properties.

Figure 8:
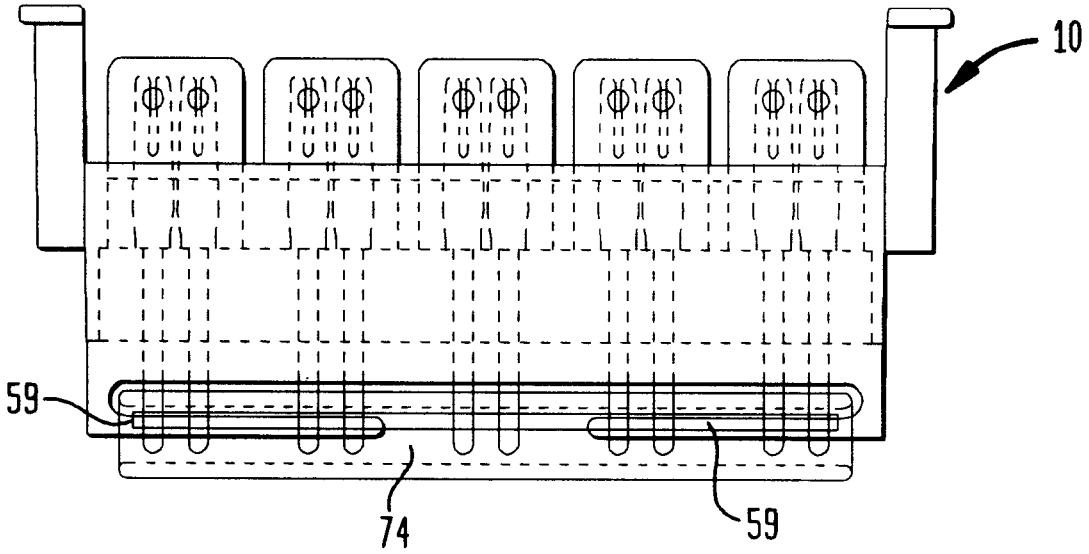

To maintain the ribbon wire 74 in a fixed position, the ribbon wire 74 is fed through the slot 54 of the wire guide 46. To avoid having to thread the entire ribbon wire 74 through the slot 54, the ribbon wire 74 is urged laterally through the channel 58 and into the slot 54. The ribbon wire 74 is disposed across the members 59 (as shown in FIG. 8) to inhibit removal of the ribbon wire 74 from the slot 54. The wire guide 54 restricts movement transverse to the longitudinal axis of the ribbon wire 74.

Referring again to FIG. 7, the slot 54 is preferably located closer to the base 12 than the PWB 60 in a mounted state, thereby requiring the ribbon wire 74 to define a bend 84 at, or in proximity to, the wire guide 54, thus providing additional strain relief to the ribbon wire 74.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A wire connector block for receiving a plurality of wire connectors, said wire connector block being mountable into an opening formed in a mounting surface, said wire block comprising:

a base for mounting thereon the plurality of wire connectors; and, a wire guide extending from said base, said wire guide having a guide body with opposing first and second surfaces, said first and second surfaces being spaced apart in a direction along a first axis of said base, and a slot extending between and through said first and second surfaces of said guide body with said slot being wholly spaced from said base, said slot being formed to allow the passage therethrough of a ribbon wire, wherein a first distance is defined between said first and second surfaces, and wherein said base has a greater length than said first distance in a direction along said first axis.

2. A wire connector block as in claim 1, wherein said slot is formed to be generally parallel to said base.

3. A wire connector block as in claim 1, wherein a peripheral edge extends between said first and second surfaces of said guide body, a channel being formed to extend through a portion of said peripheral edge and into communication with said slot.

4. A wire connector as in claim 3, wherein said channel is spaced from said base.

5. A wire connector as in claim 3, wherein said guide body is formed with elongated members having inner surfaces which define portions of said slot, and ends defining said channel.

6. A wire connector as in claim 5, wherein said channel defines a width smaller than a width defined by said slot.

7. A method for connecting a ribbon wire to wire connectors mounted on a wire connector block, said method comprising the steps of, providing a base for mounting thereon the plurality of wire connectors; and, providing a wire guide extending from said base, said wire guide having a guide body with opposing first and second surfaces, said first and second surfaces being spaced apart in a direction along a first axis of said base, and a slot extending between and through said first and second surfaces of said guide body with said slot being wholly spaced from said base, said slot being formed to allow the passage therethrough of a ribbon wire, wherein a first distance is defined between said first and second surfaces, and wherein said base has a greater length than said first distance in a direction along said first axis;

providing a printed wire board;

connecting said printed wire board to said wire connectors;

connecting said ribbon wire to said printed wire board; and manipulating the connected ribbon wire to have insulated portions thereof extend across and in proximity to said printed wire board so as to define an enclosed space therebetween.

8. A method as in claim 7, wherein said step of manipulating the connected ribbon wire includes sharply bending the connected ribbon wire so as to cause strain relief therein.

9. A method as in claim 8, wherein said printed wire board is formed with a top surface which faces said wire connector block, and wherein said step of connecting said ribbon wire to said printed wire board includes connecting said ribbon wire to said top surface of said printed wire board.

10. A method as in claim 9, wherein said step of manipulating the connected ribbon wire includes sharply bending the connected wire ribbon about a portion of said printed wire board.

11. A method as in claim 7 further comprising the steps of providing a wire guide having a slot formed therethrough, and passing said connected wire ribbon through said slot of said wire guide.

12. A method for connecting a ribbon wire to wire connectors mounted on a wire connector block, said method comprising the steps of, providing a printed wire board;

connecting said printed wire board to said wire connectors;

connecting said ribbon wire to said printed wire board; and manipulating the connected ribbon wire to have insulated portions thereof extend across and in proximity to said printed wire board so as to define an enclosed space therebetween; and injecting material into said space, said material being resistant to the passage of moisture therethrough.

13. A method as in claim 12, wherein said material is silicon gel.

14. An assembly comprising:

a wire connector block having a base;

a plurality of wire connectors mounted on said base;

a printed wire board connected to said wire connectors; and a ribbon wire connected to said printed wire board, an insulated portion of said ribbon wire extending across and in proximity to said printed wire board to define a space therebetween; and a wire guide extending from said base, said wire guide being formed with a slot extending therethrough, said ribbon wire passing through said slot.

15. An assembly as in claim 14, wherein said printed wire board includes a top surface facing said wire connectors, said ribbon wire being connected to said top surface of said printed wire board.

16. An assembly as in claim 15, wherein said ribbon wire is bent about a portion of said printed wire board so as to provide strain relief to said ribbon wire.

17. An assembly as in claim 14, wherein said guide body includes opposing first and second surfaces, and a peripheral edge extending therebetween, said slot extending between and through said first and second surfaces, a channel being formed to extend through a portion of said peripheral edge and into communication with said slot.

18. An assembly as in claim 14, wherein said wire connectors are insulation displacement connectors.

19. An assembly comprising:

a wire connector block having a base;

a plurality of wire connectors mounted on said base;

a printed wire board connected to said wire connectors;

a ribbon wire connected to said printed wire board, an insulated portion of said ribbon wire extending across and in proximity to said printed wire board to define a space therebetween and;

material disposed in said space, said material being resistant to the passage of moisture therethrough.

20. An assembly as in claim 19, wherein said material is silicon gel.

* * * * *